US007323415B2

(12) United States Patent
Shiho et al.

(10) Patent No.: US 7,323,415 B2
(45) Date of Patent: Jan. 29, 2008

(54) POLISHING PAD FOR SEMICONDUCTOR WAFER, POLISHING MULTILAYERED BODY FOR SEMICONDUCTOR WAFER HAVING SAME, AND METHOD FOR POLISHING SEMICONDUCTOR WAFER

(75) Inventors: Hiroshi Shiho, Tokyo (JP); Yukio Hosaka, Tokyo (JP); Kou Hasegawa, Tokyo (JP); Nobuo Kawahashi, Tokyo (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 10/529,742

(22) PCT Filed: Apr. 23, 2004

(86) PCT No.: PCT/JP2004/005963

§ 371 (c)(1),
(2), (4) Date: Jan. 6, 2006

(87) PCT Pub. No.: WO2005/104199

PCT Pub. Date: Nov. 3, 2005

(65) Prior Publication Data

US 2006/0128271 A1 Jun. 15, 2006

(51) Int. Cl.
*H01L 21/302* (2006.01)

(52) U.S. Cl. ..... 438/691; 438/692; 451/41

(58) Field of Classification Search ..... 438/690, 438/691, 692; 252/79.1; 451/6, 41, 533
See application file for complete search history.

(56) References Cited

U.S. PATENT DOCUMENTS

2002/0173231 A1* 11/2002 Hasegawa ..... 451/6
2003/0129931 A1* 7/2003 Konno et al. ..... 451/285
2004/0118051 A1* 6/2004 Shiho et al. ..... 51/295
2004/0203320 A1* 10/2004 Hosaka et al. ..... 451/6
2004/0224611 A1* 11/2004 Aoi et al. ..... 451/6
2004/0224616 A1 11/2004 Shiho et al.

(Continued)

FOREIGN PATENT DOCUMENTS

JP 9-7985 1/1997

(Continued)

*Primary Examiner*—Kin-Chan Chen
(74) *Attorney, Agent, or Firm*—Oblon, Spivak, McClelland, Maier & Neustadt, P.C.

(57) ABSTRACT

An objective of the present invention is to provide a polishing pad for a semiconductor wafer and a laminated body for polishing of a semiconductor wafer equipped with the same which can perform optical endpoints detection without lowering the polishing performance as well as methods for polishing of a semiconductor wafer using them. The polishing pad of the present invention comprises a substrate 11 for a polishing pad provided with a through hole penetrating from surface to back, a light transmitting part 12 fitted in the through hole, the light transmitting part comprises a water-insoluble matrix material (1,2-polybutadiene) and a water-soluble particle (β-cyclodextrin) dispersed in the water-insoluble matrix material, and the water-soluble particle is less than 5% by volume based on 100% by volume of the total amount of the water-insoluble matrix material and the water-soluble particle. In addition, the laminated body for polishing of the present invention comprises a supporting layer on a backside of the polishing pad. These polishing pad and laminated body for polishing can comprise a fixing layer 13 on a backside.

27 Claims, 9 Drawing Sheets

U.S. PATENT DOCUMENTS

| | | | | |
|---|---|---|---|---|
| 2004/0259484 | A1* | 12/2004 | Prasad et al. | 451/287 |
| 2005/0014376 | A1 | 1/2005 | Shiho et al. | |
| 2006/0037699 | A1* | 2/2006 | Nakamori et al. | 156/345.12 |

FOREIGN PATENT DOCUMENTS

| | | |
|---|---|---|
| JP | 11-512977 | 11/1999 |
| JP | 2000-326220 | 11/2000 |

* cited by examiner

POLISHING PAD FOR SEMICONDUCTOR WAFER, POLISHING MULTILAYERED BODY FOR SEMICONDUCTOR WAFER HAVING SAME, AND METHOD FOR POLISHING SEMICONDUCTOR WAFER

TECHNICAL FIELD

The present invention relates to a polishing pad for a semiconductor wafer and a laminated body for polishing of a semiconductor wafer equipped with the same as well as methods for polishing of a semiconductor wafer. More particularly, the present, invention relates to a polishing pad for a semiconductor wafer through which can transmit the light without decreasing the polishing performance, and a laminated body for polishing of a semiconductor wafer equipped with the same as well as methods for polishing of a semiconductor wafer. The polishing pad for a semiconductor wafer, and a laminated body for polishing of a semiconductor wafer equipped with the same, as well as methods for polishing of a semiconductor wafer of the present invention are suitable as a method for performing polishing of a semiconductor wafer or the like while polishing state is observed using an optical endpoints detecting apparatus.

BACKGROUND TECHNOLOGY

In polishing of a semiconductor wafer, determination of a polishing endpoints at which polishing is performed can be known based on the criteria of the empirically obtained time. However, there are a variety of materials constituting the surface to be polished, and polishing times are all different depending upon the materials. In addition, materials constituting the surface to be polished are considered to change variously in future. Further, this is the same in the case of slurries and polishing apparatuses used for polishing. For this reason, it is so inefficient to obtain all polishing times in a variety of different polishing. On the other hand, recently, the optical endpoints detecting apparatus and method using an optical method which can directly measure the state of the surface to be polished have been studied, for example, as in JP-A-9-7985, JP-A-2000-326220 and the like.

In this optical endpoints detection apparatus and method, generally, a window not having essential ability such as absorption and transportation of slurry particles, which is composed of a hard uniform resin, through which the light for detecting an endpoints can transmit, is formed into a polishing pad, and the surface to be polished is observed only through this window, as disclosed in JP-A-11-512977 and the like.

However, since the window in the above-mentioned polishing pad has substantially no ability to retain and discharge the slurry, there is a possibility that provision of a window decreases the polishing ability of a polishing pad, and leads nonuniformity. In addition, for this reason, it is difficult to enlarge the window (provision in an annular manner and the like) and increase the number of the windows.

DISCLOSURE OF THE INVENTION

The present invention is to solve the above-mentioned problems and an objective of the present invention is to provide a polishing pad for a semiconductor wafer through which can transmit endpoints detecting light without lowering polishing performance, upon polishing of a semiconductor wafer while polishing status is observed using an optical endpoints detecting apparatus, and a laminated body for polishing of a semiconductor wafer equipped with the same as well as method for polishing of a semiconductor wafer.

The present inventors studied a polishing pad for a semiconductor wafer using an optical endpoints detecting apparatus and found that, when not a hard uniform resin substantially having no ability to retain and discharge a slurry as before, but a light transmitting part having light transmitting properties are used as a window, sufficient light transmitting properties can be maintained and, further, detection of a polishing endpoints is possible. In addition, the present inventors found that, by dispersion and inclusion of water-soluble particles in a matrix material constituting a window, it enables to have ability to retain and discharge a slurry at polishing. Further, the present inventors found that even when a content of the water-soluble particles is less than 5% by volume, sufficient polishing performance is exerted, which resulted in completion of the present invention.

The polishing pad for a semiconductor wafer of the present invention is characterized in that it comprises a substrate for a polishing pad provided with a through hole penetrating from surface to back, and a light transmitting part fitted in the through hole, wherein the light transmitting part comprises a water-insoluble matrix material and a water-soluble particle dispersed in the water-insoluble matrix material, and wherein a content of the water-soluble particle is not less than 0.1% by volume and less than 5% by volume based on 100% by volume of the total amount of the water-insoluble matrix material and the water-soluble particle.

In addition, the polishing pad for a semiconductor wafer of the other present invention is characterized in that it comprises a substrate for a polishing pad provided with a through hole penetrating from surface to back, a light transmitting part fitted in the through hole, and a fixing layer formed on a backside of at least the substrate for a polishing pad among the substrate for a polishing pad and the light transmitting part for fixing to a polishing apparatus, wherein the light transmitting part comprises a water-insoluble matrix material and a water-soluble particle dispersed in the water-insoluble matrix material, and wherein a content of the water-soluble particle is 0.1 to 90% by volume based on 100% by volume of the total amount of the water-insoluble matrix material and the water-soluble particle.

The laminated body for polishing of a semiconductor wafer of the present invention is characterized in that it comprises the above polishing pad for a semiconductor wafer, and a supporting layer laminated on a backside of the polishing pad for a semiconductor wafer, wherein the laminate has light transmitting properties in a laminated direction.

In addition, the laminated body for polishing of a semiconductor wafer of the other present invention is characterized in that it comprises a substrate for a polishing pad provided with a through hole penetrating from surface to back, a light transmitting part fitted in the through hole, a supporting layer laminated on a backside of at least the substrate for a polishing pad among the substrate for a polishing pad and the light transmitting part, and a fixing layer formed on a backside of the supporting layer for fixing to a polishing apparatus, wherein the light transmitting part comprises a water-insoluble matrix material and a water-soluble particle dispersed in the water-insoluble matrix material, and wherein a content of the water-soluble particle is 0.1 to 90% by volume based on 100% by volume of the total amount of the water-insoluble matrix material and the water-soluble particle.

Further the present method for polishing a semiconductor wafer is characterized in that a semiconductor wafer is polished using the above polishing pad for a semiconductor wafer or the above laminated body for polishing of a semiconductor wafer, and a polishing endpoints of a semiconductor wafer by the use of an optical endpoints detecting apparatus.

MODE FOR CARRYING OUT THE INVENTION

The present invention will be explained in detail below.

The polishing pad for a semiconductor wafer (hereinafter also referred to as "polishing pad") of the present invention is characterized in that it comprises a substrate for a polishing pad provided with a through hole penetrating from surface to back, and a light transmitting part fitted in the through hole, wherein the light transmitting part comprises a water-insoluble matrix material and a water-soluble particle dispersed in the water-insoluble matrix material, and wherein a content of the water-soluble particle is not less than 0.1% by volume and less than 5% by volume based on 100% by volume of the total amount of the water-insoluble matrix material and the water-soluble particle.

The "substrate for a polishing pad" can usually retain the slurry on the surface thereof and, further, make wastages reside transiently. The transmitting properties of this substrate for a polishing pad may be present or absent. In addition, a planar shape thereof is not particularly limited but may be circle, ellipse, polygon (such as square and the like) or the like. A size thereof is not particularly limited.

It is preferable that a slurry is retained on a surface of a substrate for a polishing pad at polishing, and wastages reside transiently on a surface as described above. For this reason, the surface may be provided with at least one of a fine pore (hereinafter referred to as "pore"), a groove, and fuzz formed by dressing and the like. In addition, these may be pre-formed, or may be formed at polishing. Therefore, examples of the substrate for a polishing pad include:

[1] a substrate having a water-insoluble matrix material (a) and a water-soluble part (b) of a particulate shape or a linear shape, which is dispersed in this water-insoluble matrix material (a),

[2] a substrate having a water-insoluble matrix material (a) and a bubble dispersed in this water-insoluble matrix material (a) (foamed body), and

[3] a substrate consisting only of a water-insoluble matrix material (a) (non-foamed body), on which fuzz are produced by dressing, and the like.

A material constituting the water-insoluble matrix material (a) in the [1] to [3] is not particularly limited but a variety of materials can be used. In particular, it is preferable that an organic material is used because it is easily molded into a prescribed shape and nature and can give the suitable elasticity. As this organic material, a variety of materials which are applied as a water-insoluble matrix material constituting a light transmitting part described later can be used. A material constituting the substrate for a polishing pad and a material constituting a light transmitting part may be the same or different, and light transmitting properties may be present or absent. In addition, as the water-soluble part (b) in the [1], parts composed of a variety of materials which are applied to a water-soluble particle of a light transmitting part described later can be used. In the [2], a water-insoluble matrix material constituting a substrate for a polishing pad, and a water-insoluble matrix material constituting a light transmitting part may be the same, or a material constituting a water-soluble part and a material constituting a water-soluble particle may be the same.

In addition, an amount of the water-soluble part (b) is preferably 0.1 to 90% by mass, more preferably 10 to 90% by mass, further preferably 12 to 60% by mass, particularly preferably 15 to 45% by mass based on 100% by volume of the total amount of the water-insoluble matrix material (a) and the water-soluble part (b). When the content of a water-soluble part (b) is less than 0.1% by volume, a sufficient amount of pores are not formed during polishing and the like, and a removal rate is reduced in some cases. On the other hand, when the content exceeds 90% by volume, it becomes difficult in some cases to sufficiently prevent a water-soluble part (b) contained in the water-insoluble matrix material (a) from serially swelling or dissolving, and it becomes difficult to retain the hardness and the mechanical strength of a polishing pad at an appropriately value.

The "through hole" penetrates the substrate for a polishing pad from the surface to the back and a light transmitting part is fitted in this through hole (provided that, a part of a through hole is opened at a side end of a polishing pad). The through hole may be completely filled with a light transmitting part (FIG. 1 and the like), or only a part thereof may be filled with a light transmitting part (FIG. 2 and the like).

A shape of the through hole is not particularly limited but, for example, a planar shape of the opening thereof may be a circular, a fan-shaped (a shape obtained by removing a predetermined angle part from a circular or an annulus), a polygonal (triangle, regular square, trapezoid and the like), an annulus and the like. In addition, a corner of an opening may be pointed, or rounded. Further, a cross-sectional shape of the through hole may be, for example, a square such as trapezoid and the like, a T-letter shape, a reverse T-letter shape or other shape (see FIGS. 1, 2, 3, 4, 5, 6, 7, 8, 12 and 13; an upper side in each figure is a polishing side).

A size of one of the through holes is also not particularly limited. When a planar shape of an opening is circle, it is preferable that the size is ⅔ or less a radius of a polishing pad, specifically, it is preferable that a diameter is 20 mm or more. In addition, when a planar shape of an opening is annular, it is preferable that the size is ⅔ or less a radius of polishing pad, specifically, it is preferable that a width thereof is 20 mm or more. Further, when a planar shape of an opening is square, it is preferable that one side is ⅔ or less a radius of a polishing pad, specifically, it is preferable that a vertical length is 30 mm or more and a horizontal length is 10 mm or more. When the through hole is smaller than a size of the above-mentioned each example, it may become difficult in some cases to assuredly transmit the light such as the endpoints detecting light.

In addition, the number of through holes provided in a substrate for a polishing pad is not particularly limited.

Then, the above-mentioned "light transmitting part" comprises a water-insoluble matrix material and a water-soluble particle dispersed in this water-insoluble matrix material, and refers to a part which has light transmitting properties, and is provided in a through hole of a polishing pad.

A shape of the light transmitting part is not particularly limited. Since a planar of the light transmitting part on a polishing side of a polishing pad usually depends on a shape of a through hole, the shape is the same as a shape of a through hole. Therefore, a planar of a light transmitting part may be a circular or a polygonal described above for the through hole. In addition, a cross-sectional shape of a light transmitting part is also not particularly limited but is usually a shape, at least a part of which may be fitted in a through hole. For example, cross-sectional shapes as shown in FIGS. 1, 2, 3, 4, 5, 6, 7, 8, 12 and 13 may be used. A through hole may have a gap between a light transmitting part and a substrate for a polishing pad, but it is preferable that the through hole does not have the gap. When the gap is possessed, a length thereof is preferably 2 mm or less, more preferably 1 mm or less, further preferably 0.5 mm or less.

In addition, the light transmitting part may not be thinned as in FIGS. 1, 3, 12 and 13, that is, the light transmitting part may have the same thickness as that of a substrate for a polishing pad, or may be thinned. Thinning includes both of making a thickness of a light transmitting part thinner than a maximum thickness of a substrate for a polishing pad (FIGS. 2, 4, 5, 6 and 8, and the like), and molding by thinning a part of the above-mentioned light transmitting part through which the light transmits in the light transmitting part itself (FIG. 7 and the like).

When light transmits through a light transmitting part, the intensity of the light is declined in proportion to square of a thickness of a light transmitting part. Therefore, by thinning a light transmitting part, light transmitting properties can be remarkably improved. For example, in a polishing pad used in polishing in which endpoints detection is performed optically, even when it is difficult to obtain light having a sufficient intensity for detecting an endpoints where this light transmitting part has the same thickness as that of other part of a substrate for a polishing pad, the intensity of the light sufficient for detecting an endpoints can be maintained by thinning. However, a thickness of this thinned light transmitting part is preferably 0.1 mm or more, more preferably 0.3 mm or more, provided that an upper limit is usually 3 mm. When the thickness is less than 0.1 mm, it becomes difficult in some cases to sufficiently retain the mechanical strength of a light transmitting part.

In addition, a concave part in which a light transmitting part is not existed in the through hole formed by thinning (see FIG. 2) and that of the light transmitting part (see FIG. 7) may be formed in which side of one side and the reverse side of a substrate for a polishing pad. Forming a concave part on the backside (non-polishing side) makes thickness of the light transmitting part thinner considering no effect of polishing properties.

The number of the above-mentioned light transmitting parts is not particularly limited but may be 1 or 2 or more. In addition, arrangement of the part is also not particularly limited. For example, when one light transmitting part is provided, a light transmitting part may be arranged as shown in FIG. 9 and FIG. 10. Further, when 2 or more light transmitting parts are provided, they may be arranged concentrically (FIG. 11).

In addition, light transmitting properties possessed by a light transmitting part usually means that, in the case where a thickness of a polishing pad is 2 mm, transmittance at a wavelength between 100 and 3000 nm is 0.1% or more, or an integrated transmittance in a wavelength range between 100 and 3000 nm is 0.1 or more. This transmittance or integrated transmittance is preferably 1% or more, more preferably 2% or more. However, this transmittance or integrated transmittance may not be higher than necessary, and is usually 50% or less, may be 30% or less and, further 20% or less.

In a polishing pad when polishing is performed while a polishing endpoints is detected with an optical endpoints detecting apparatus, it is preferable that the light transmittance at a wavelength ranges between 400 and 800 nm which is a region most frequently used as the endpoints detecting light is high. For this reason, it is preferable that, in the case where a thickness is 2 mm, the light transmittance at a wavelength between 400 and 800 nm is 0.1% or more (more preferably 1% or more, more preferably 2% or more, particularly preferably 3% or more, usually 90% or less), or the integrated transmittance at a wavelength range between 400 and 800 nm is 0.1% or more (more preferably 1% or more, more preferably 2% or more, particularly preferably 3% or more, usually 90% or less). This transmittance or integrated transmittance may not be higher than that as required. Usually, it is 20% or less, may be 10% or less, further 5% or less.

This transmittance is a value by measuring a light transmittance of a test piece having a thickness of 2 mm with a UV absorbance measuring device which can measure the absorbance at a prescribed wavelength is used to measure transmittance at that wavelength. The integrated transmittance can be obtained by integrating the transmittance at a prescribed wavelength region measured similarly.

As long as the "water-insoluble matrix material" (hereinafter also referred to "matrix material") constituting the light transmitting part has the light transmitting properties (whether the visible light is transmitted or not), the material itself needs not to be transparent (including translucent). It is preferable that the light transmitting properties are higher. It is more preferable that the material is transparent. Therefore, it is preferable that the matrix material is a thermoplastic resin, a thermosetting resin, an elastomer, a rubber and the like alone which can give light transmitting properties, or a combination thereof.

Examples of the thermoplastic resin include, for example, a polyolefin-based resin, a polystyrene-based resin, a polyacrylic-based resin [(meth)acrylate-based resin and the like], a vinyl ester resin (except for an acrylic resin), a polyester-based resin, a polyamide-based resin, a fluorine resin, a polycarbonate resin, a polyacetal resin and the like.

Examples of the thermosetting resin include, for example, a phenol resin, an epoxy resin, an unsaturated polyester resin, a polyurethane resin, a polyurethane urea resin, an urea resin, a silicone resin and the like.

Examples of the elastomer include thermoplastic elastomers, such as styrene-butadiene-styrene block copolymer (SBS), hydrogenated block copolymer thereof (SEBS) and the like, polyolefin elastomer (TPO), thermoplastic polyurethane elastomer (TPU), thermoplastic polyester elastomer (TPEE), polyamide elastomer (TPAE), diene-based elastomers (1,2-polybutadiene and the like) and the like, silicone resin-based elastomer, fluorine resin-based elastomer and the like.

Examples of the rubber include a butadiene rubber, a styrene-butadiene rubber, an isoprene rubber, an isobutylene-isoprene rubber, an acrylic rubber, an acrylonitrile-butadiene rubber, an ethylene-propylene rubber, an ethylene-propylene-diene rubber, a silicone rubber, a fluorine rubber and the like.

The above-mentioned materials may be modified by having at least one kind of functional group selected from the group consisting of an acid anhydride group, a carboxyl group, a hydroxyl group, an epoxy group, an amino group and the like. Modification can adjust the affinity and the like with a water-soluble particle described later, an abrasive, an aqueous medium and the like. In addition, these materials can be used in combination of two or more.

In addition, the above-mentioned respective materials may be a crosslinked polymer, or a non-crosslinked polymer. As a material constituting the above-mentioned light transmitting part in the present invention, it is preferable that at least a part of a matrix material (including the case where a material is composed of a mixture of two or more kinds of materials, at least a part of at least one kind among them is a crosslinked polymer, and the case where a material is composed of one kind of a material, at least a part thereof is a crosslinked polymer) is a crosslinked polymer.

At least a part of the matrix material having a crosslinking structure can give the elastic recovering force to a matrix material. Therefore, a displacement by a shearing stress applied to the polishing pad during polishing can be suppressed less, and pores are prevented from being buried due to plastic deformation by excess stretching of the matrix material during both polishing and dressing. In addition, the surface of the polishing pad can be prevented from excessively fuzzing. For this reason, the slurry is well retained during polishing, the retaining properties of the slurry by dressing are easily recovered and, further scratching can be prevented from occurring.

Examples of the above-mentioned crosslinked polymer, among the above-mentioned thermoplastic resin, thermosetting resin, elastomer and rubber which can impart light transmitting properties, resins such as a polyurethane resin, an epoxy resin, a polyacrylic-based resin, an unsaturated polyester resin, a vinyl ester resin (except for a polyacrylic resin) and the like, polymers obtained by crosslinking-reacting a diene-based elastomer (1,2-polybutadiene), a butadiene rubber, an isoprene rubber, an acrylic rubber, an acrylonitrile-butadiene rubber, a styrene-butadiene rubber, an ethylene-propylene rubber, a silicone rubber, a fluorine rubber, a styrene-isoprene rubber and the like, and polymers obtained by crosslinking (with a crosslinking agent, irradiation of an ultraviolet-ray or an electoron beam) polyethylene, polyfluorinated vinylidene and the like. Besides, ionomer and the like may be used.

Among these crosslinked polymers, crosslinked 1,2-polybutadiene is particularly preferable because it can give the sufficient light transmitting properties, is stable to a strong acid or a strong alkali contained in many slurries and, further, is hardly softened due to water absorption. This crosslinked 1,2-polybutadiene can be used by blending with other rubbers such as butadiene rubber and isoprene rubber and the like. As the matrix material, 1,2-polybutadiene can be used alone.

In such the matrix material in which at least a part thereof is a crosslinked polymer can render the residual elongation after breaking (hereinafter referred to as "break residual elongation") 100% or less when a test piece formed by the matrix material is broken at 80° C. according to JIS K 6251. That is, a matrix material can be obtained in which a total distance between marked lines of bench mark in a test piece after breaking is 2 or less-fold a distance between the marked lines before breaking. This break residual elongation is preferably 30% or less, more preferably 10% or less, further preferably 5% or less. The break residual elongation is usually 0% or greater. As the break residual elongation is exceeding 100%, fine fragments scratched or elongated from the surface of a polishing pad during polishing and surface updating tend to easily clog pores.

A break residual elongation is an elongation obtained by subtracting a distance between the marked lines before test from the total of the two distance between respective the marked line and broken parts of broken and divided test pieces, when a test piece is broken in a tensile test at a test piece shape of dumbbell No.3, a tensile rate of 500 mm/min and a test temperature of 80° C. according to JIS K 6251 "Tensile test method on a vulcanized rubber". Regarding a test temperature, since a temperature obtained by gliding in actual polishing is around 80° C., the test was performed at this temperature.

The above-mentioned "water-soluble particle" is dispersed in a water-insoluble matrix material. Also, as described above, this particle is a particle which can form a pore by contact with a slurry or an aqueous medium supplied from the outside in polishing.

A shape of this water-soluble particle is not particularly limited but is preferably near spherical, more preferably spherical. In addition, it is preferable that respective water-soluble particles are similar in a shape. This makes shapes of formed pores uniform and, thus, better polishing can be performed.

In addition, a size of the water-soluble particle is not particularly limited but is, usually, 0.1 to 500 μm, preferably 0.5 to 200 μm, further preferably 1 to 150 μm. When the particle size is less than 0.1 μm, a size of a pore is smaller than that of an abrasive in some times and an abrasive is not sufficiently retained in a pore in some times, being not preferable. On the other hand, when the particle size exceeds 500 μm, the size of a formed pore becomes too large, and there is a tendency that the mechanical strength of the light transmitting part and the removal rate are lowered.

An amount of the water-soluble particle contained in a light transmitting part is not less than 0.1% by volume and less than 5% by volume, preferably not less than 0.5% by volume and less than 5% by volume, particularly preferably not less than 1% by volume and 4.9% or less by volume based on 100% by volume of the total amount of the water-insoluble matrix material and the water-soluble particle. When the content of the water-soluble particle is less than 0.1% by volume, a sufficient amount of pores are not formed, and a removal rate tends to be lowered. On the other hand, even when a content is less than 5% by volume, sufficient polishing performance can be imparted.

A material constituting the water-soluble particle is not particularly limited but a variety of materials can be used. For example, an organic-based water-soluble particle and an inorganic-based water-soluble particle may be used.

As the organic-based water-soluble particle, particles composed of dextrin, cyclodextrin, mannitol, sugars (lactose and the like), celluloses (hydroxypropylcellulose, methylcellulose and the like), starch, protein, polyvinyl alcohol, polyvinyl pyrrolidone, polyacrylic acid, polyethylene oxide, water-soluble photosensitive resin, sulfonated polyisoprene, sulfonated polyisoprene copolymer and the like may be used.

In addition, as the inorganic-based water-soluble particle, particles composed of potassium acetate, potassium nitrate, calcium carbonate, potassium hydrogencarbonate, potassium chloride, potassium bromide, potassium phosphate, magnesium nitrate and the like may be used.

These water-soluble-particles may contain the above-mentioned respective materials alone or a combination of two or more. Further, those particles may be one kind water-soluble particle composed of a prescribed material, or two or more kinds of water-soluble particles composed of different materials.

In addition, it is preferable that only water-soluble particles exposed on the surface of a light transmitting part are dissolved in water, and water-soluble particles existing in the interior of the light transmitting part without emerging on the surface do not absorb a moisture and are not swollen, at polishing. For this reason, an outer shell composed of epoxy resin, polyimide, polyamide, polysilicate and the like for inhibiting moisture absorption may be formed on at least a part of an outermost part of the water-soluble particle.

The water-soluble particle has the function of conforming an indentation hardness of a light transmitting part with that of other parts of a polishing pad such as a substrate for a polishing pad and the like, in addition to the function of forming a pore. In order to increase a pressure which is applied at polishing, enhance a removal rate, and obtain high flatness, it is preferable that a Shore D hardness is 35 to 100 in a whole of a polishing pad. However, it is difficult in many cases to obtain a desired Shore D hardness only from a material of a matrix material and, in such the case, inclusion of a water-soluble particle enables to improve a Shore D hardness to the same degree as that of other parts of a polishing pad, in addition to form a pore. From such the reason, it is preferable that a water-soluble particle is a solid particle which can retain a sufficient indentation hardness in a polishing pad.

A method of dispersing the water-soluble particle in the matrix material at manufacturing is not particularly limited. Usually, the dispersing is realized by kneading a matrix material, a water-soluble particle and other additives. In this kneading, a matrix material is kneaded while heating so as to be easily processed. It is preferable that the water-soluble particle is solid at kneading temperature. When the particle is solid, the water-soluble particle is easily dispersed in the state where the above-mentioned preferable average particle size is retained, regardless of a magnitude of the compatibility with the matrix material. Therefore, it is preferable that a kind of water-soluble particle is selected depending upon a processing temperature of the used matrix material.

In addition, besides a matrix material and a water-soluble particle, a compatibilizing agent (a polymer, a block copolymer and a random copolymer which are modified with an acid anhydride group, a carboxyl group, a hydroxyl group, an epoxy group, an oxazoline group, an amino group and the like), a variety of nonionic surfactants, a coupling agent, and a residue thereof for improving affinity with and dispersity of the matrix material and the water-soluble particle which are added as necessary at manufacturing may be contained.

Further, not only a light transmitting part, but also at least one kind of an abrasive, an oxidizing agent, a hydroxide of an alkali metal, an acid, a pH adjusting agent, a surfactant, a scratching preventing agent and the like which have previously been contained in the slurry may be contained in a whole polishing pad of the present invention such as a substrate for a polishing pad and the like.

Besides, various additives such as a filler, a softening agent, an antioxidant, an ultraviolet absorbing agent, an antistatic agent, a sliding agent, a plasticizer and the like may be contained. In particular, examples of the filler include materials for improving the rigidity such as calcium carbonate, magnesium carbonate, talc, clay and the like, and materials having the polishing effects such as silica, alumina, ceria, zirconia, titania, manganese dioxide, dimanganese trioxide, barium carbonate and the like.

On the other hand, a groove and a dot pattern having a prescribed shape can be formed on a surface (polishing surface) of the polishing pad of the present invention, if necessary, in order to improve drainability of a used slurry. When such the grooves and dot pattern are necessary, they may be also obtained by forming a concave from a polishing pad generated by the above-mentioned thinning of a light transmitting part on a surface side.

Further, a shape of the polishing pad of the present invention is not particularly limited but usually depends on a shape of a substrate for a polishing pad. Therefore, the shape may be a circular (disc and the like), a polygonal (square and the like) and the like. In the case of a square, it may be a belt-like, a roller-like or the like. In addition, a size of the polishing pad of the present invention is also not particularly limited but in the case of a disc, a diameter can be 500 to 900 mm.

As used herein, the "slurry" means an aqueous dispersion containing at least an abrasive. However, the slurry or only an aqueous medium without abrasive may be supplied from the outside during polishing. When only an aqueous medium is supplied, for example, the slurry can be formed by mixing an abrasive released from the interior of the polishing pad and the aqueous medium during polishing.

Alternatively, the polishing pad of the present invention may be other polishing pad of the present invention, by providing a backside (non-polishing surface) opposite to the polishing surface with a fixing layer 13 for fixing a polishing pad to a polishing apparatus, as shown in FIG. 12 and FIG. 13. This fixing layer is not particularly limited as far as it can fix a polishing pad itself.

As this polishing layer 13, for example, a layer formed using a double-coated tape (that is, provided with an adhesive layer 131 and a peeling layer 132 formed on a superficial most layer), an adhesive layer 131 formed by coating with an adhesive, or the like may be used. A peeling layer 132 can be provided on a superficialmost layer of an adhesive layer formed by coating with an adhesive.

A material constituting these fixing layers is not particularly limited but a thermoplastic type, a thermosetting type, a photocuring type and the like of an acrylic-based resin, a synthetic rubber and the like can be used. Example of a commercially available material include #442 manufactured by 3M, #5511 manufactured by Sekisui Chemical Co., Ltd. and #5516 manufactured by Sekisui Chemical Co., Ltd.

Among these fixing layers, a layer formed using a double-coated tape is preferable because it has a peeling layer in advance. In addition, in any fixing layer, provision with a peeling layer can protect an adhesive layer until use and, upon use, a polishing pad can be easily fixed to a polishing apparatus with a sufficient adhering force by removing this peeling layer.

In addition, in a fixing layer, light transmitting properties of a material itself constituting a fixing layer is not particularly limited. When a material constituting a fixing layer has no light transmitting properties, or has low light transmitting properties, a through hole or the like may be provided at a site corresponding to a light transmitting part. An area of this through hole may be larger or smaller than, or the same as an area of a light transmitting part. When a through hole is smaller than a light transmitting part, and is formed so as to cover a part where a substrate for a polishing pad and a light transmitting part are contacted as shown in FIG. 12 and FIG. 13, a slurry and the like can be prevented from leaking out on a backside even when a gap is possessed between a substrate for a polishing pad and a light transmitting part. Alternatively, in particular, by providing a fixing layer with a through hole, a sensor part for measuring light transmitting degree, and a site for emitting transmitting light can be prevented from being polluted. For this reason, it is preferable that a fixing layer is not formed, in particular, in a passage for transmitting light.

Further, when a fixing layer formed from a double-coated tape is formed, a through hole may be provided at a prescribed position of a double-coated tape in advance. A method of forming this through hole is not particularly limited, but examples are not limited to, but include a method using a laser cutter, and a method of punching with a punching blade. In the method of using a laser cutter, a through hole may be provided after a fixing layer is provided with a double-coated tape.

The polishing pad for a semiconductor wafer of the other present invention is characterized in that it comprises a substrate for a polishing pad provided with a through hole penetrating from surface to back, a light transmitting part fitted in the through hole, and a fixing layer formed on a backside of at least the substrate for a polishing pad among the substrate for a polishing pad and the light transmitting part for fixing to a polishing apparatus, wherein the light transmitting part comprises a water-insoluble matrix material and a water-soluble particle dispersed in the water-insoluble matrix material, and wherein a content of the water-soluble particle is 0.1 to 90% by volume based on 100% by volume of the total amount of the water-insoluble matrix material and the water-soluble particle.

As the "substrate for a polishing pad", the above-mentioned substrate for a polishing pad can be applied as it is.

As the "light transmitting part", explanation of the above-mentioned light transmitting part except for a content by volume of a water-soluble particle can be applied as it is. A content of this water-soluble particle is 0.1 to 90% by volume, preferably 0.5 to 60% by volume, particularly preferably not less than 1% by volume and not more than 40% by volume based on 100% by volume of the total amount of the water-insoluble matrix material and the water-soluble particle. When the content of the water-soluble particle is less than 0.1% by volume, a sufficient amount of pores are not formed, and a removal rate tends to be lowered. On the other hand, when the content exceeds 90% by volume, there is a tendency that a water-soluble particle contained in the matrix material can not be sufficiently prevented from serially swelling or dissolving, and it becomes difficult to retain the hardness and the mechanical strength of a light transmitting part at an appropriately value.

As the "fixing layer", the above-mentioned fixing layer can be applied as it is.

In addition, the above-mentioned various materials which have previously been contained in a slurry may be contained in a whole of another polishing pad (in particular, substrate for polishing pad, light transmitting part and the like) of the present invention and, further, the above-mentioned other various additives may be contained therein. In addition, a groove and a dot pattern having a prescribed shape may be formed on its surface (polishing surface) as described above. Further, a shape of a polishing pad is not limited but the same shape and size as those described above may be adopted;

A laminated body for polishing of a semiconductor wafer (hereinafter also referred to as "laminated body for polishing") of the present invention is characterized in that it comprises the above polishing pad for a semiconductor wafer, and a supporting layer laminated on a backside of the polishing pad for a semiconductor wafer, wherein the laminate has light transmitting properties in a laminated direction.

The "supporting layer" is a layer to be laminated on the backside which is a side opposite the polishing surface of a polishing pad. Light transmitting properties of a supporting layer may be present or absent, and light transmitting properties in a laminated body for polishing can be maintained by using a supporting body composed of a material having light transmitting properties equivalent to or exceeding light transmitting properties of a light transmitting part (in this case, a notch may be formed or not formed). Further, when a supporting layer having no light transmitting properties is used, the light transmitting properties of the laminated body for polishing is ensured by methods of forming a vacancy at a part to be passed through the light and the like.

A shape of a supporting layer is not particularly limited but a planar shape may be, for example, a circular, a polygonal (square) and the like. Further, the supporting layer may be usually thin plate-like. Usually, this supporting layer may have the same planer shape as that of the polishing pad (in the case the supporting layer has a part ensuring the transmitting properties by vacancy, the part may not be considered).

Further, material constituting the above-mentioned supporting layer is not particularly limited but a variety of materials may be used. In particular, it is preferable that an organic material is used because it is easily molded into a prescribed shape and nature and also it can give the suitable elasticity. As this organic material, various materials which are applied as the above-mentioned matrix material constituting a light transmitting part can be used. A material constituting a supporting layer, and a material constituting a matrix material for a light transmitting part and/or a substrate for a polishing pad may be the same or different.

The number of the supporting layers is not limited but may be one layer, or two or more layers. Further, when two or more supporting layers are laminated, respective layers may be the same or different. In addition, a hardness of the supporting layer is also not particularly limited but it is preferable that the supporting layer is softer than a polishing pad. Thereby, a whole laminated body for polishing can have sufficient flexibility, and can be provided with suitable conformity with irregularities on a surface to be polished.

In addition, the laminated body for polishing of the present invention may be provided with the same fixing layer as that of the above-mentioned polishing pad, provided that this fixing layer is usually formed on a backside of a supporting layer (on a side opposite to a polishing surface).

Further, the above-mentioned various materials which have previously been contained in a slurry may be contained in a whole laminated body for polishing (in particular, substrate for polishing pad, light transmitting part, and the like) of the present invention as in the above-mentioned polishing pad and, further, the above-mentioned other various additives may be contained therein. In addition, the above-mentioned grooves and dot pattern having a prescribed shape may be provided on its surface (polishing surface). Further, a shape and a size of the laminated body for polishing are not limited but may be the same shape and size as those of the above-mentioned polishing pad.

The laminated body for polishing of a semiconductor wafer of the other present invention is characterized in that it comprises a substrate for a polishing pad provided with a through hole penetrating from surface to back, a light transmitting part fitted in the through hole, a supporting layer laminated on a backside of at least the substrate for a polishing pad among the substrate for a polishing pad and the light transmitting part, and a fixing layer formed on a backside of the supporting layer for fixing to a polishing apparatus, wherein the light transmitting part comprises a water-insoluble matrix material and a water-soluble particle dispersed in the water-insoluble matrix material, and wherein a content of the water-soluble particle is 0.1 to 90% by volume based on 100% by volume of the total amount of the water-insoluble matrix material and the water-soluble particle.

As the "substrate for a polishing pad", the above-mentioned substrate for a polishing pad can be applied as it is.

As the "light transmitting part", the above-mentioned water-soluble particle in other polishing pad of the present invention can be applied as it is.

As the "fixing layer", the above-mentioned fixing layer can be applied as it is.

In addition, the above-mentioned various materials which have previously been contained in a slurry may be contained in another laminated body for polishing (in particular, substrate for polishing pad, light transmitting part and the like) of the present invention, as in the above-mentioned polishing pad and, further, the above-mentioned other various additives may be contained therein. In addition, the above-mentioned grooves and dot pattern having a described shape may be provided on the polishing surface. Further, a shape and a size of the laminated body for polishing are not limited but the same shape and size as those of the above-mentioned laminated body for polishing of the present invention may be adopted.

The present method for polishing a semiconductor wafer is characterized in that a semiconductor wafer is polished using the above polishing pad for a semiconductor wafer or the above laminated body for polishing of a semiconductor wafer, and a polishing endpoints of a semiconductor wafer by the use of an optical endpoints detecting apparatus.

The "optical endpoints detecting apparatus" is an apparatus for transmitting light from a backside (non-polishing surface) of a polishing pad to a polishing surface through a light transmitting part, and detecting a polishing endpoints from reflected light from a polishing surface of a material to be polished such as a semiconductor wafer and the like. Other measuring principle is not particularly limited.

According to the method for polishing a semiconductor wafer of the present invention, endpoints detection can be performed without lowering the polishing performance of a polishing pad or a laminated body for polishing. For example, when a polishing pad or a laminated body for polishing has a disc-like shape, by providing the light transmitting part in an annular manner being concentric with the center of this disc, it becomes possible to polish while usually observing a polishing point. Therefore the polishing may be finished at the most polishing point certainly.

In the method for polishing a semiconductor wafer of the present invention, for example, a polishing apparatus as shown in FIG. 14 may be used. That is, the polishing apparatus is an apparatus provided with a rotatable surface plate 2, a pressure head 3 being capable of rotating and moving in vertical and horizontal directions, a slurry supplying part 5 which can drop the slurry on the surface plate at a constant amount per unit time, and an optical endpoints detector 6 mounted under the surface plate.

In this polishing apparatus, a polishing pad (or a laminated body for polishing) 1 of the present invention is fixed on the surface plate. On the other hand, a semiconductor wafer 4 is fixed on a lower end side of a pressure head, and this semiconductor wafer 4 is abutted against the polishing pad while pushing with a prescribed pressure. Then, while a prescribed amount of the slurry is added dropwise on the surface plate from the slurry supplying part, the surface plate and the pressure head are rotated to slide the semiconductor wafer and the polishing pad, to perform polishing.

In addition, upon this polishing, the endpoints detecting light R1 at a prescribed wavelength or a wavelength region is transmitted though a light transmitting part 11 from an optical endpoints detecting part from a lower side of the surface plate (the endpoints detecting light can transmit the surface plate when the surface plate itself has the light transmitting properties or a vacancy part is formed at a part of surface plate), irradiating the light towards a polishing surface of a semiconductor wafer. Then, the reflected light R2 which is this endpoints detective light reflected on the surface of the semiconductor wafer to be polished is captured by the optical endpoints detecting part, and polishing can be performed while observing the situations of the polishing surface from an intensity of this reflected light.

BEST MODE FOR CARRYING OUT THE INVENTION

Figure 1:
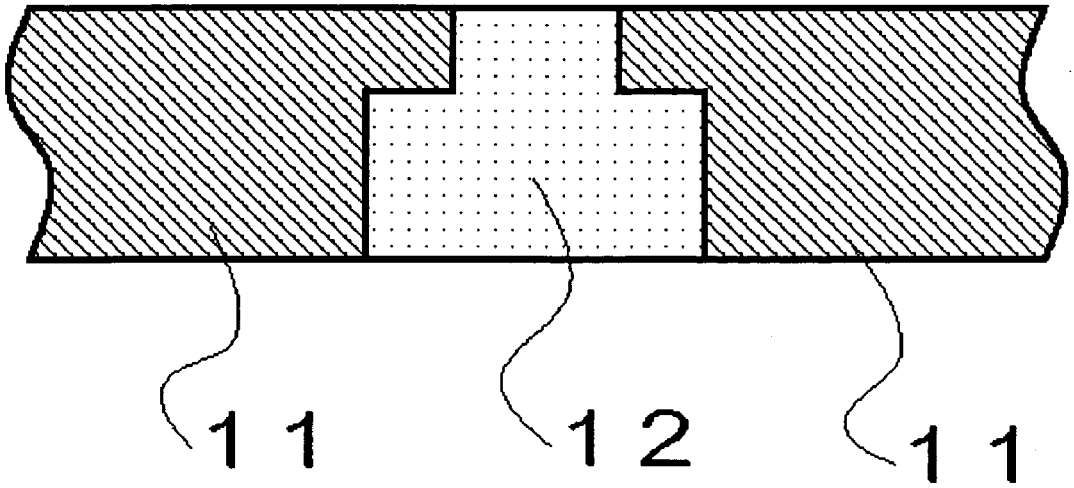
FIG. 1 is a schematic view showing an example of a shape of a substrate for polishing pad and a light transmitting part, and the fitted respectively state.
Figure 2:
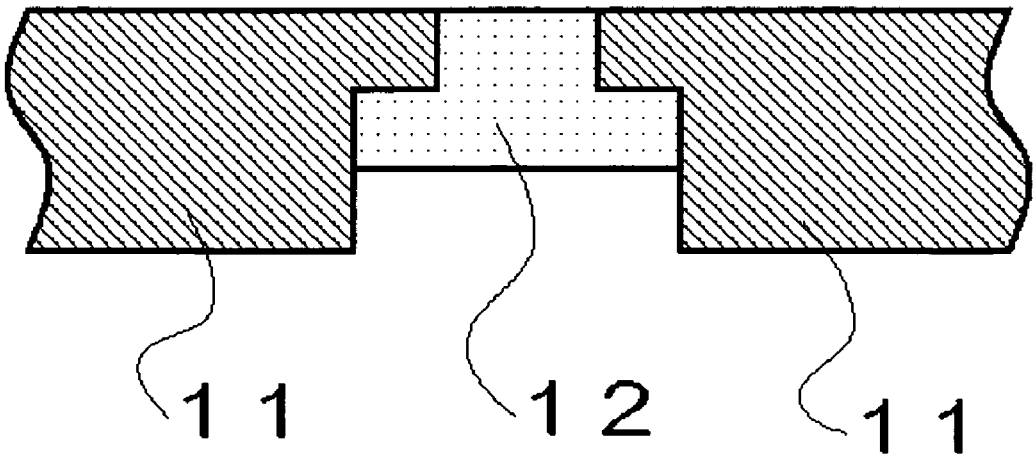
FIG. 2 is a schematic view showing an example of a shape of a substrate for polishing pad and a light transmitting part, and the fitted respectively state.
Figure 3:
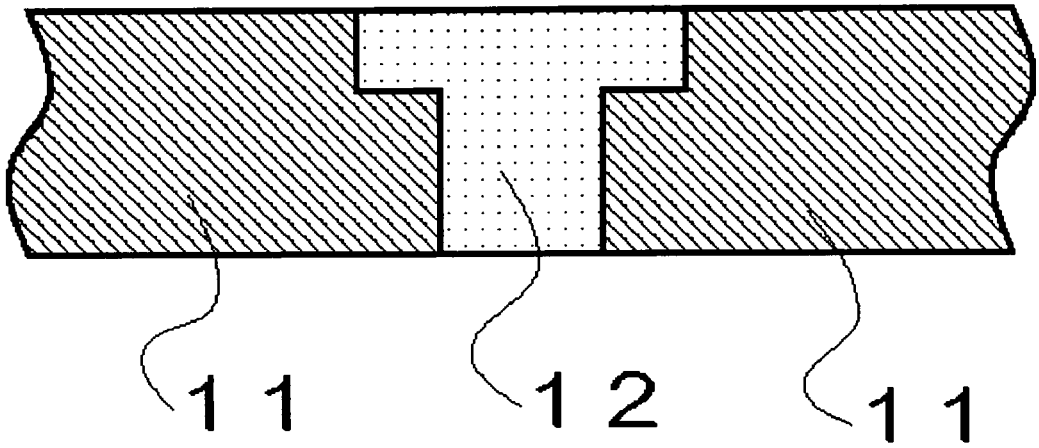
FIG. 3 is a schematic view showing an example of a shape of a substrate for polishing pad and a light transmitting part, and the fitted respectively state.
Figure 4:
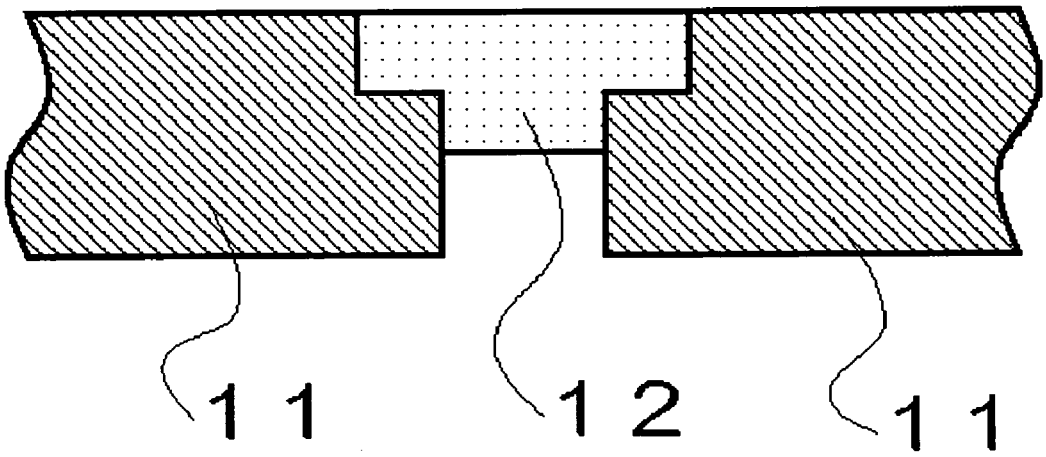
FIG. 4 is a schematic view showing an example of a shape of a substrate for polishing pad and a light transmitting part, and the fitted respectively state.
Figure 5:
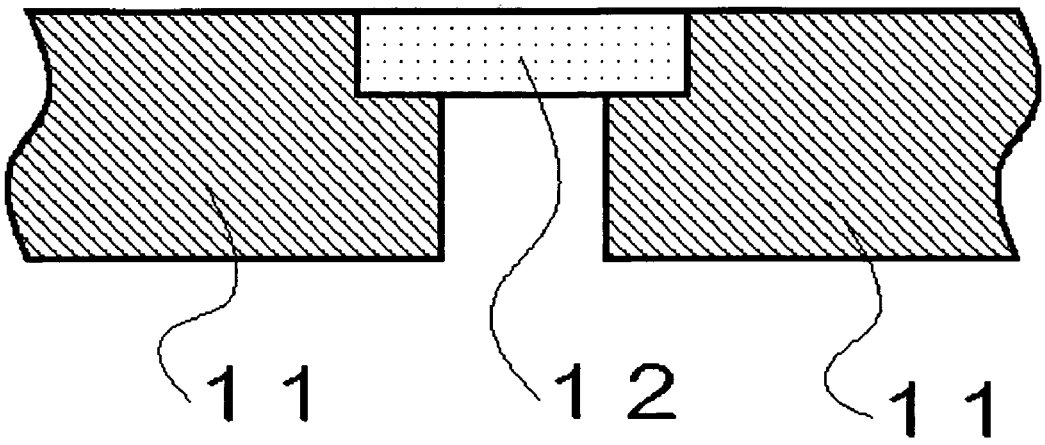
FIG. 5 is a schematic view showing an example of a shape of a substrate for polishing pad and a light transmitting part, and the fitted respectively state.
Figure 6:
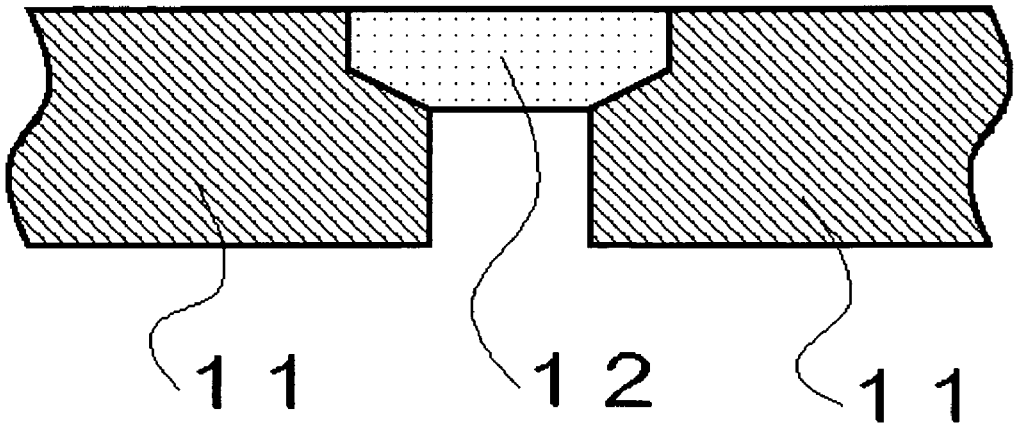
FIG. 6 is a schematic view showing an example of a shape of a substrate for polishing pad and a light transmitting part, and the fitted respectively state.
Figure 7:
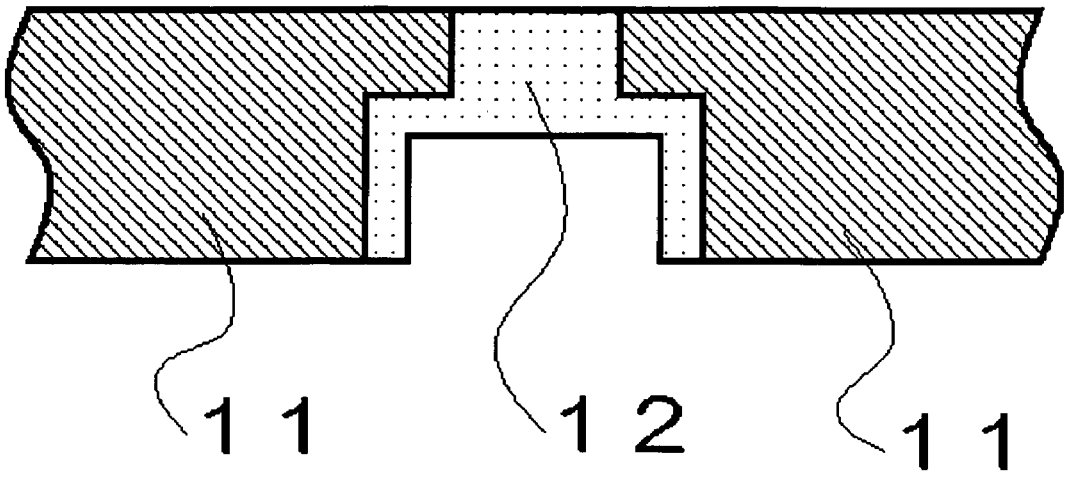
FIG. 7 is a schematic view showing an example of a shape of a substrate for polishing pad and a light transmitting part, and the fitted respectively state.
Figure 8:
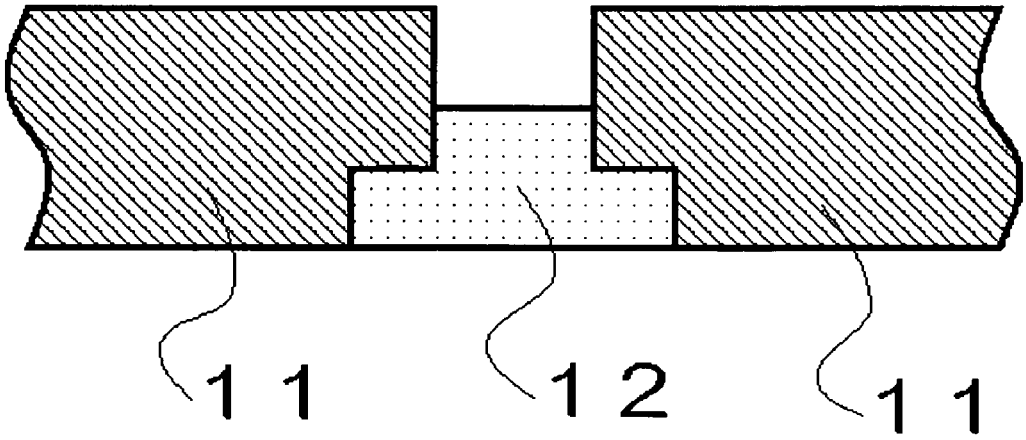
FIG. 8 is a schematic view showing an example of a shape of a substrate for polishing pad and a light transmitting part, and the fitted respectively state.
Figure 9:
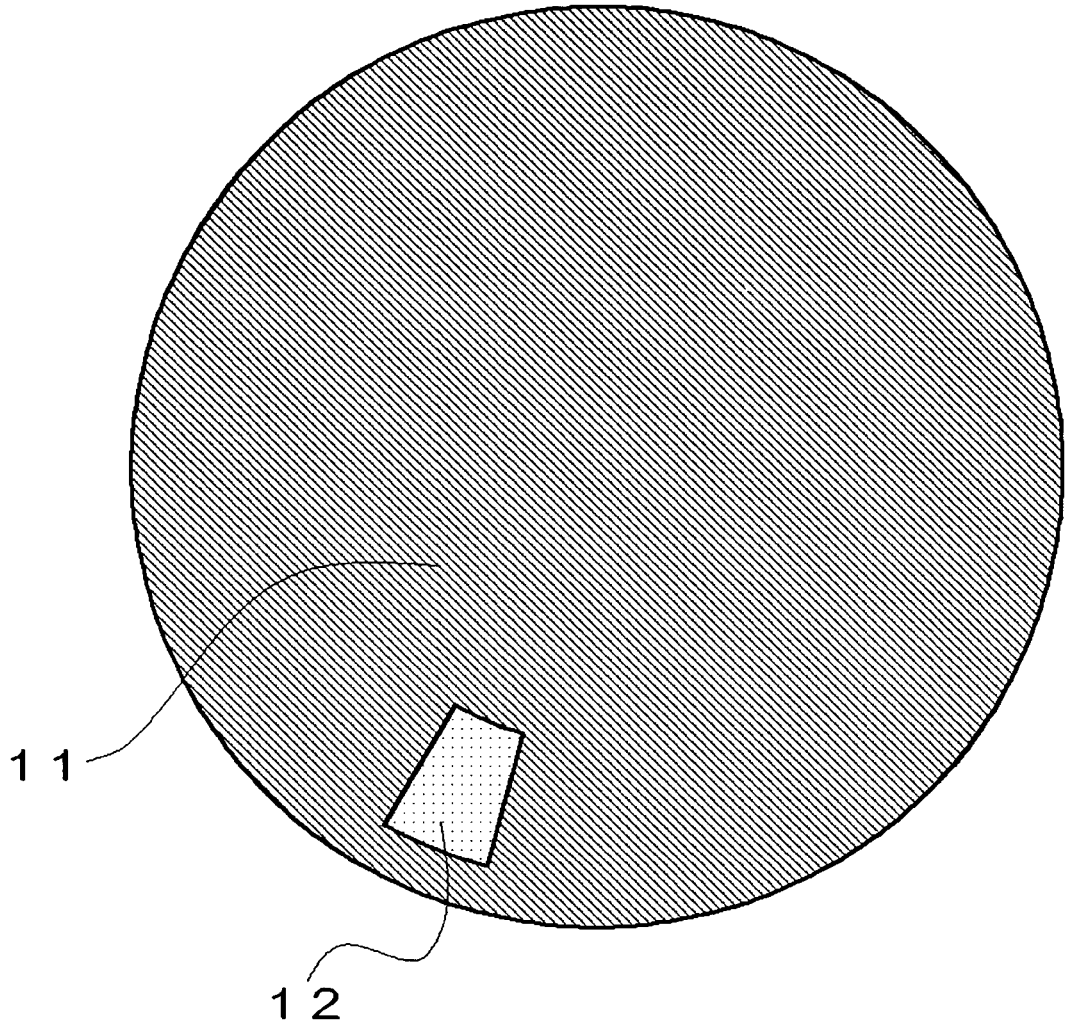
FIG. 9 is a plain view of one example of the polishing pad of the present invention.
Figure 10:
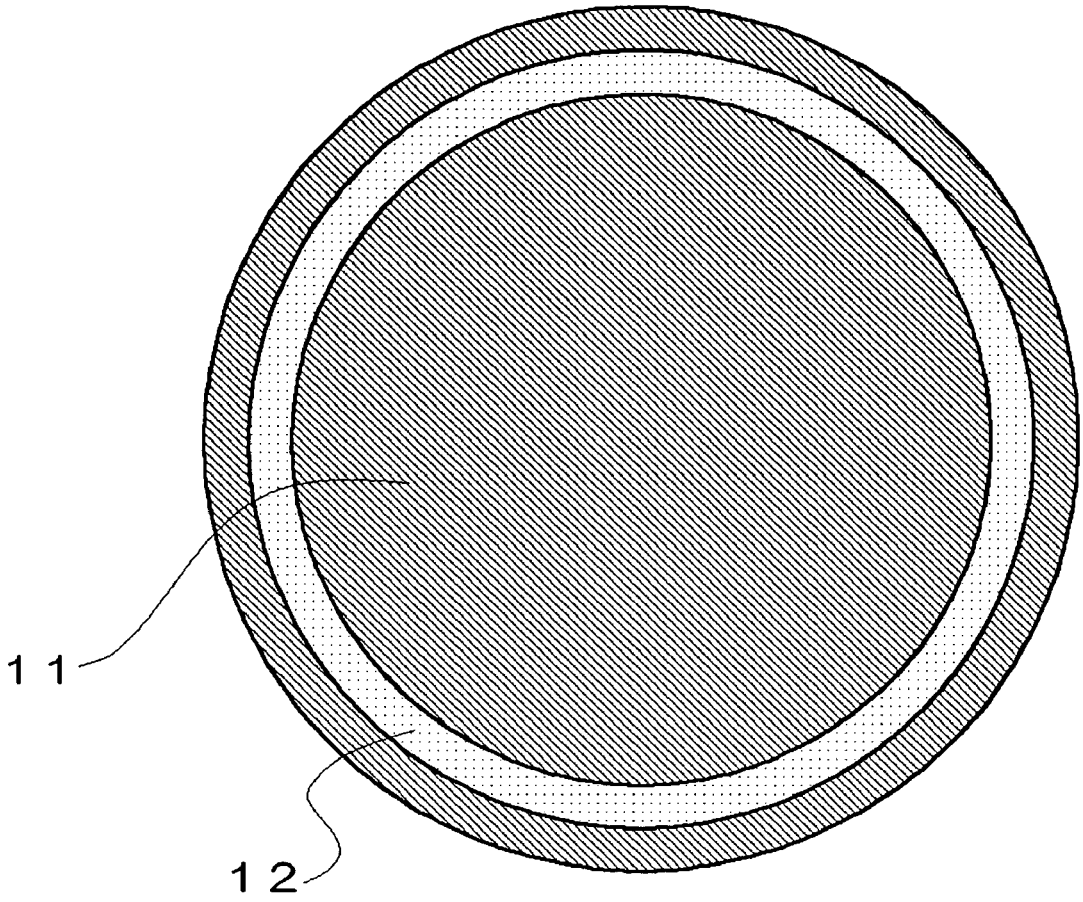
FIG. 10 is a plain view of another example of the polishing pad of the present invention.
Figure 11:
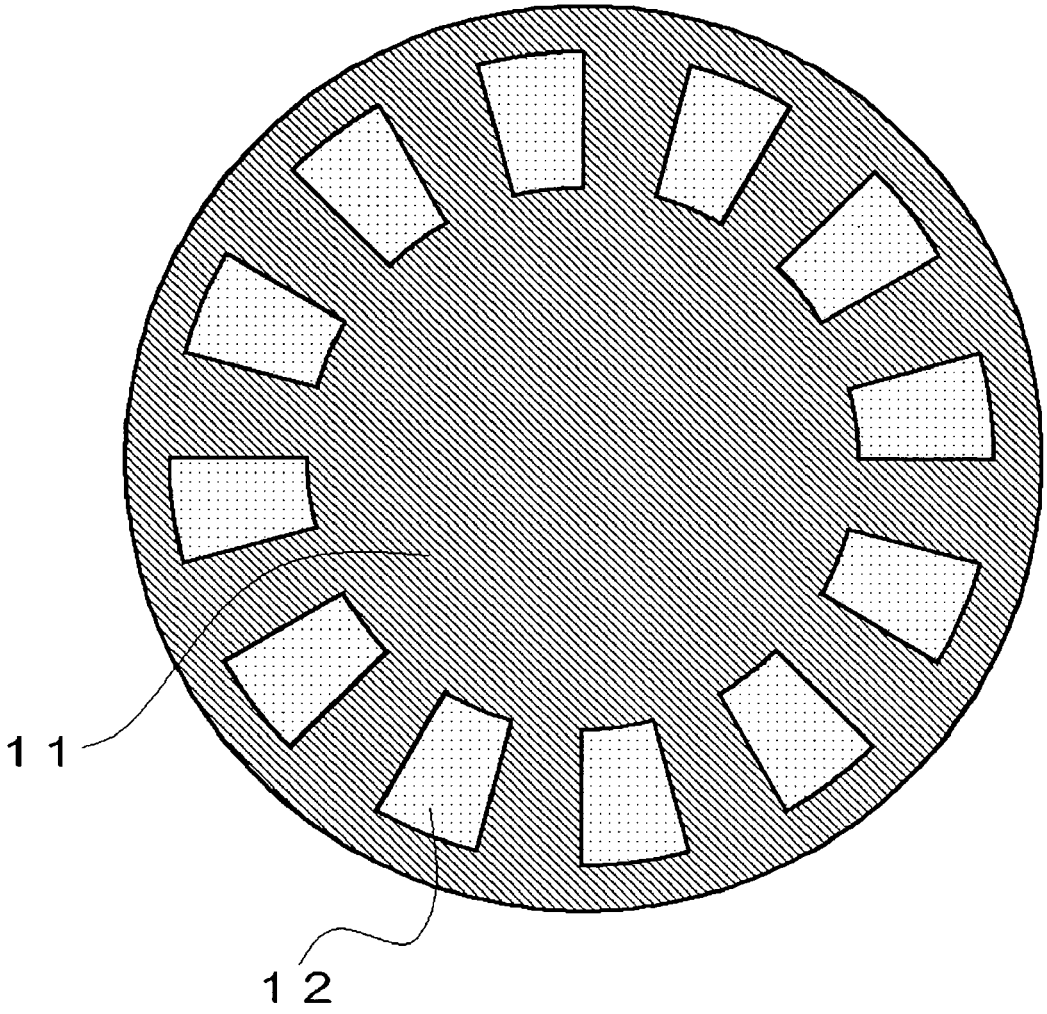
FIG. 11 is a plain view of one example of the-polishing pad of the present invention.
Figure 12:
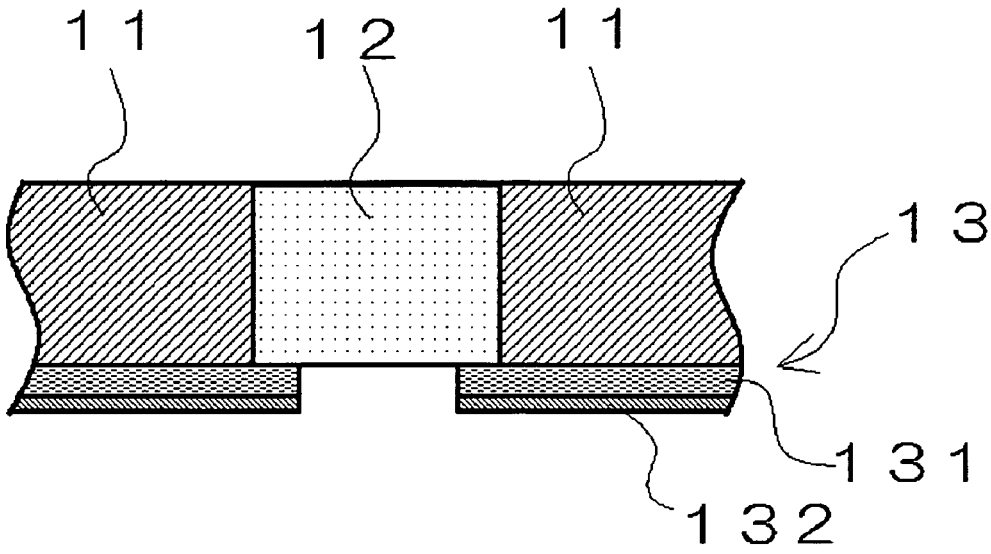
FIG. 12 is a schematic view of one example of a polishing pad provided with a fixing layer.
Figure 13:
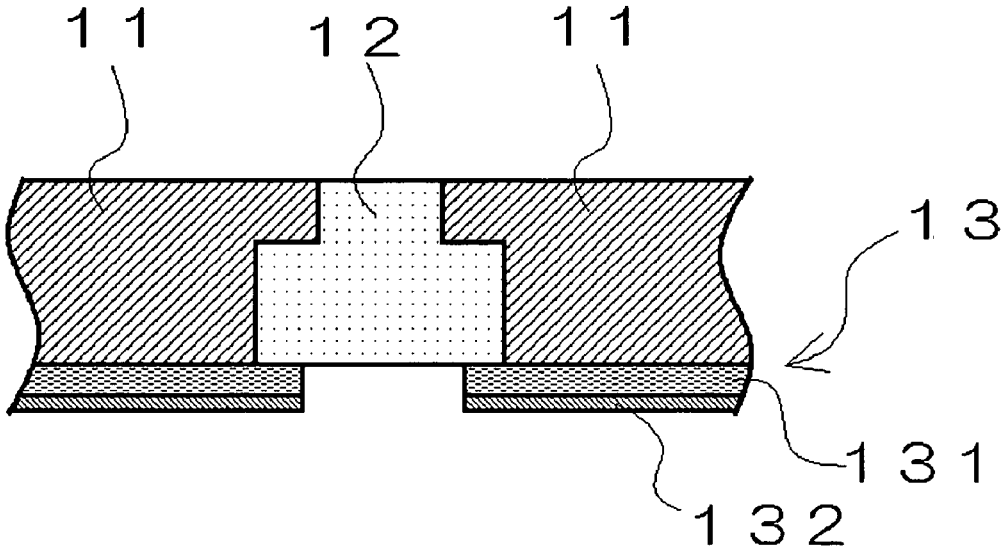
FIG. 13 is a schematic view of another example of a polishing pad provided with a fixing layer.
Figure 14:
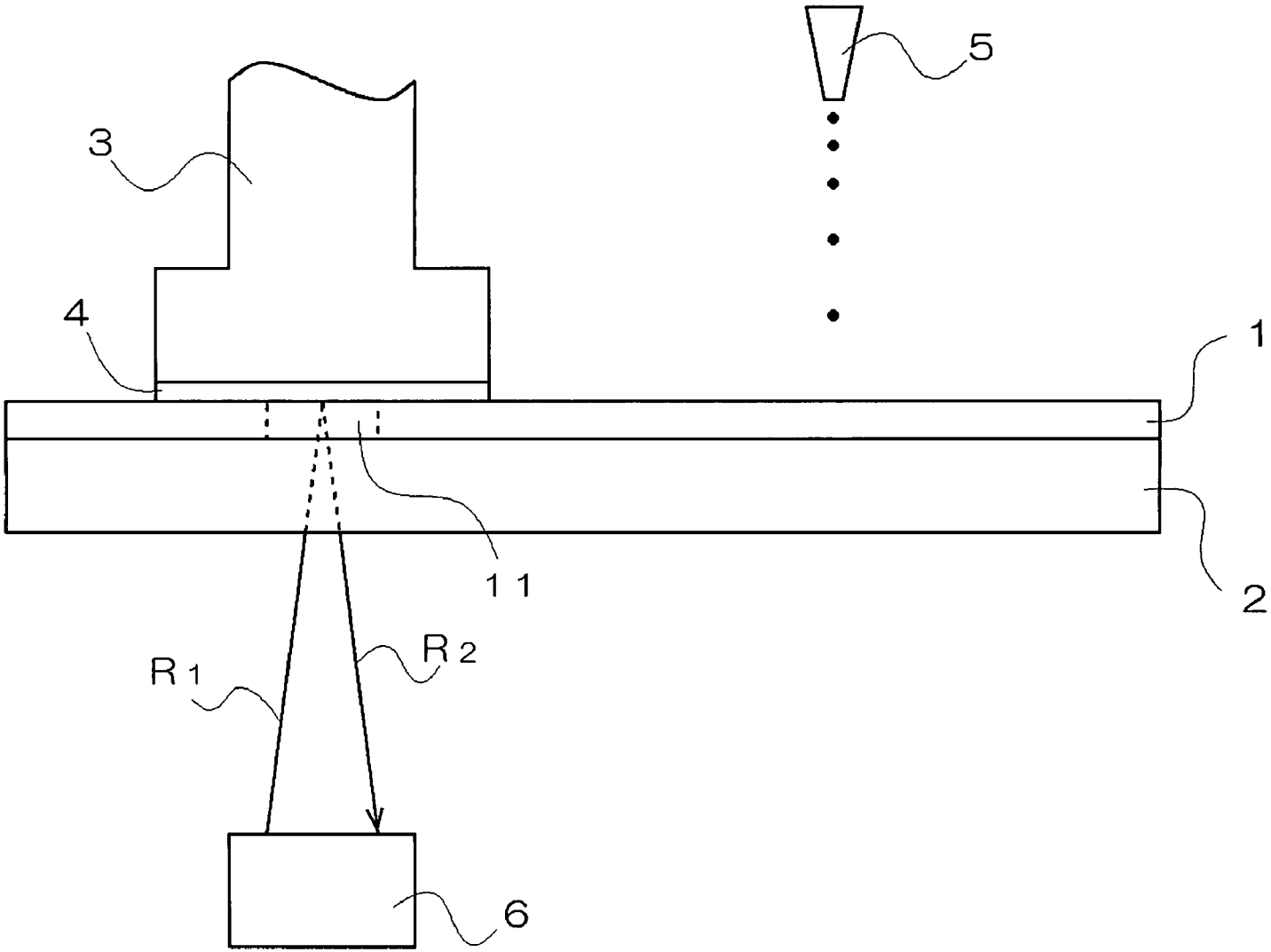
FIG. 14 is a schematic view showing a polishing apparatus using a polishing pad or a laminated body for polishing of the invention.

The present invention is concretely described in the following examples.

[1] Preparation of Test Pad (1) Preparation of Light Transmitting Part

97% by volume of 1,2-polybutadiene (trade name "JSR RB830" manufactured by JSR Corp.) which becomes a water-insoluble matrix material by crosslinking later, and 3% by volume of β-cyclodextrin (trade name "Dexypearl β-100" manufactured by Yokohamakokusaibiokenkyusho Co. Ltd.) were kneaded with a kneader heated to 120° C. Thereafter, 0.8 part by mass of dicumyl peroxide (trade name "Percumyl D" manufactured by NOF Corp.) was added to a total of 100 parts by mass of total of 1,2-polybutadiene and β-cyclodextrin, which was further kneaded, reacted to crosslink at 170° C. for 20 minutes in a press mold, and molded to obtain a disc-like light transmitting part having a diameter of 60 cm and a thickness of 2.5 mm.

(2) Preparation of Substrate for Polishing Pad

80% by volume of 1,2-polybutadiene (trade name "JSR B830" manufactured by JSR Corp.) which becomes a water-insoluble matrix material by crosslinking later, and 20% by volume of β-cyclodextrin (trade name "Dexypearl β-100" manufactured by Yokohamakokusaibiokenkyusho Co. Ltd.) were kneaded with a kneader heated to 120° C. Thereafter, 0.8 part by mass of dicumyl peroxide (trade name "Percumyl D" manufactured by NOF Corp.) was added to a total of 100 parts by mass of total of 1,2-polybutadiene and β-cyclodextrin, which was further kneaded, reacted to crosslink at 170° C. for 20 minutes in a press mold, and molded to obtain a disc-like substrate for polishing pad having a diameter of 60 cm and a thickness of 2.5 mm.

[2] Measurement of the Transmittance

The transmittance of the light transmitting part obtained in the [1] (1) at a wavelength 650 nm was measured using a UV absorbance measuring device (Model "U-2010" manufactured by Hitachi Ltd.). As a result, an average integrated transmittance of five times was 30%.

[3] Measurement of the Polishing Performance

The polishing pad composed only of the light transmitting part obtained in the [1] (1) was mounted on a surface plate of a polishing apparatus, and a hot-oxidized layer wafer was polished under the conditions of a surface plate rotation number of 50 rpm and a slurry flow of 100 cc/min. As a result, a removal rate was 980 Å/min. In addition, polishing was performed under the same conditions using the polishing pad composed only of the substrate for a polishing pad obtained in the [1] (2). As a result, a removal rate was 1010 Å/min.

Further, using a polishing pad composed of commercially available polyurethane foam having no light transmitting properties (trade name "IC1000" manufactured by Rodel Nitta), polishing was performed under the same conditions. As a result, a removal rate was 950 Å/min.

From these results, even when, a light transmitting part molded in a prescribed size as in the [1] (1) is fitted in a through hole provided on a part of a polishing pad composed of polyurethane foam having no light transmitting properties to obtain a polishing pad, which is used to perform polishing, it can be seen that the polishing performance of a polishing pad of the present invention is comparable to polishing performance of a polishing pad composed of polyurethane foam having no light transmitting properties.

EFFECT OF THE INVENTION

Since the polishing pad for a semiconductor wafer of the present invention is provided with a substrate for a polishing pad provided with a through hole penetrating from surface to back, and a light transmitting part fitted in the through hole, this light transmitting part comprises a water-insoluble matrix material, and a water-soluble particle dispersed in this water-insoluble matrix material, and a content of this water-soluble particle is not less than 0.1% by volume and less than 5% by volume based on 100% by volume of the total amount of the water-insoluble matrix material and the water-soluble particle, polishing can be proceeded without lowering polishing performance, and optical endpoints detection can be performed effectively. In addition, through a polishing step, it is possible to optically observe not only polishing endpoints at all time, but also all polishing situations.

When at least a part of a water-insoluble matrix material constituting a light transmitting part is a crosslinked polymer, burial of a pore can be prevented at polishing and dressing. In addition, the surface of the polishing pad (polishing surface) can be prevented from excessively fuzzing. Therefore, the slurry is well retained during polishing, the retaining property of the slurry by dressing is easily recovered and, further scratching can be prevented from occurring.

When a crosslinked polymer constituting a light transmitting part is crosslinked 1,2-polybutadiene, effect deriving from inclusion of the crosslinked polymer can be sufficiently exerted and, at the same time, sufficient light transmitting properties can be maintained. In addition, since the polishing pad is stable to a strong acid or a strong alkali contained in many slurries, and, further, is hardly softened due to water absorption, the polishing pad has excellent durability.

When a light transmitting part is thinned, light transmitting properties can be improved more.

When a light transmitting part has transmittance of 0.1% or higher at a prescribed wavelength, or integrated transmittance of 0.1% or higher at a prescribed wavelength region, the polishing pad is suitable in optical observation at such the wavelength or wavelength region.

Further, by provision with a fixing layer, the polishing pad can be simply and rapidly fixed to a polishing apparatus. In addition, by having light transmitting properties, light transmitting properties possessed by a light transmitting part is not inhibited.

According to other polishing pad for a semiconductor wafer of the present invention, optical endpoints detection can be performed without lowering polishing performance. In addition, throughout a polishing step, it is possible to optically observe not only polishing endpoints at all time, but also all polishing situations. In addition, the polishing pad can be simply and rapidly fixed to a polishing apparatus.

According to the laminated body for polishing of the present invention, optical endpoints detection can be performed without lowering polishing performance. In addition, throughout a polishing step, it is possible to optically observe not only polishing endpoints at all time, but also all polishing situations. In addition, a whole laminated body for polishing has sufficient flexibility, and can be provided with suitable conformity with irregularities of a surface to be polished.

Further, by provision with a fixing layer, the laminated body for polishing can be simply and rapidly fixed to a polishing apparatus. In addition, by having light transmitting properties, light transmitting properties possessed by a light transmitting part is not inhibited.

According to other laminated body for polishing of the present invention, optical endpoints detection can be performed without lowering polishing performance. In addition, through a polishing step, it is possible to optically observe not only polishing endpoints at all time, but also all polishing situation. Further, a whole laminated body for polishing can have sufficient flexibility, and can be provided with proper conformity with irregularities of a surface to be polished. In addition, the polishing pad can be simply and rapidly fixed to a polishing apparatus.

According to the method for polishing of the present invention, polishing can be proceeded without lowering polishing performance of a polishing pad or a laminated body for polishing, and optical endpoints detection can be performed effectively. In addition, it is possible to proceed polishing while optically observing not only polishing endpoints but also all polishing situation.

INDUSTRIAL APPLICABILITY

The polishing pad for semiconductor wafer of the present invention is particularly useful in a step of manufacturing a semiconductor apparatus and, for example, can be used in a STI step, a damocening step of forming a metal wiring such as Al, Cu and the like, a damocening step upon formation of a viaplug using Al, Cu, W and the like, a dual damocening step of forming these metal wiring and viaplug at the same time, a step of polishing an interlayer insulating membrane (oxidized membrane, Low-k, BPSG and the like), a step of polishing a nitride membrane (TaN, TiN and the like), or a step of polishing polysilicon, bare silicone and the like.

What is claimed is:

1. A polishing pad for a semiconductor wafer, which comprises a substrate for a polishing pad provided with a through hole penetrating from surface to back, and a light transmitting part fitted in said through hole, wherein said light transmitting part comprises a water-insoluble matrix material and a water-soluble particle dispersed in said water-insoluble matrix material, wherein a content of said water-soluble particle is not less than 0.5% by volume and less than 5% by volume based on 100% by volume of the total amount of said water-insoluble matrix material and said water-soluble particle, and wherein a thickness of said light transmitting part is from 0.1 mm to 3 mm.

2. The polishing pad for a semiconductor wafer according to claim 1, wherein at least a part of the water-insoluble matrix material is a crosslinked polymer.

3. The polishing pad for a semiconductor wafer according to claim 2, wherein said crosslinked polymer is crosslinked 1,2-polybutadiene.

4. The polishing pad for a semiconductor wafer according to claim 1, wherein said light transmitting part is thinned.

5. The polishing pad for a semiconductor wafer according to claim 1, wherein a light transmittance of said light transmitting part at a wavelength between 400 and 800 nm is 0.1% or more, or an integrated transmittance of said light transmitting part in a wavelength range between 400 and 800 nm is 0.1% or more, when a thickness of said light transmitting part is 2 mm.

6. A laminated body for polishing of a semiconductor wafer, which comprises a polishing pad for a semiconductor wafer as defined in claim 1, and a supporting layer laminated on a backside of said polishing pad for a semiconductor wafer, wherein said laminate body has light transmitting properties in a laminated direction.

7. A method for polishing a semiconductor wafer using a polishing pad for a semiconductor wafer as defined in claim 1, which comprises a process of detecting a polishing endpoint by the use of an optical endpoint detecting apparatus.

8. A method for polishing a semiconductor wafer using a laminated body for polishing of a semiconductor wafer, which comprises a polishing pad for a semiconductor wafer as defined in claim 1, and a supporting layer laminated on a backside of said polishing pad for a semiconductor wafer, wherein said laminated body has light transmitting properties in a laminated direction, and which comprises a process of detecting a polishing endpoint by the use of an optical endpoint detecting apparatus.

9. The polishing pad for a semiconductor wafer according to claim 1, wherein said polishing pad comprises a fixing layer formed on a backside of at least the substrate for a polishing pad among the substrate for a polishing pad and the light transmitting part for fixing to a polishing apparatus, and wherein said polishing pad has said through hole at a site corresponding to a light transmitting part of the fixing layer.

10. A polishing pad for a semiconductor wafer, which comprises a substrate for a polishing pad provided with a through hole penetrating from surface to back, a light transmitting part fitted in said through hole, and a fixing layer formed on a backside of at least said substrate for a polishing pad among said substrate for a polishing pad and said light transmitting part for fixing to a polishing apparatus, wherein said light transmitting part comprises a water-insoluble matrix material and a water-soluble particle dispersed in said water-insoluble matrix material, wherein a content of said water-soluble particle is 0.5 to 5% by volume based on 100% by volume of the total amount of said water-insoluble matrix material and said water-soluble particle, and wherein a thickness of said light transmitting part is from 0.1 mm to 3 mm.

11. The polishing pad for a semiconductor wafer according to claim 10, wherein said polishing pad has said through hole at a site corresponding to a light transmitting part of the fixing layer.

12. A laminated body for polishing of a semiconductor wafer, which comprises a polishing pad for a semiconductor wafer as defined in claim 10, and a supporting layer laminated on a backside of said polishing pad for a semiconductor wafer, wherein said laminated body has light transmitting properties in a laminated direction.

13. A method for polishing a semiconductor wafer using a polishing pad for a semiconductor wafer as defined in claim 10, which comprises a process of detecting a polishing endpoint by the use of an optical endpoint detecting apparatus.

14. A method for polishing a semiconductor wafer using a laminated body for polishing of a semiconductor wafer, which comprises a polishing pad for a semiconductor wafer as defined in claim 10, and a supporting layer laminated on a backside of said polishing pad for a semiconductor wafer, wherein said laminated body has light transmitting properties in a laminated direction, which comprises a process of detecting a polishing endpoint by the use of an optical endpoint detecting apparatus.

15. A laminated body for polishing of a semiconductor wafer, which comprises a substrate for a polishing pad provided with a through hole penetrating from surface to back, a light transmitting part fitted in said through hole, a supporting layer laminated on a backside of at least said substrate for a polishing pad among said substrate for a polishing pad and said light transmitting part, and a fixing layer formed on a backside of said supporting layer for fixing to a polishing apparatus, wherein said light transmitting part comprises a water-insoluble matrix material and a water-soluble particle dispersed in said water-insoluble matrix material, wherein a content of said water-soluble particle is 0.5 to 5% by volume based on 100% by volume of the total amount of said water-insoluble matrix material and said water-soluble particle, and wherein a thickness of said light transmitting part is from 0.1 mm to 3 mm.

16. The laminated body for polishing of a semiconductor wafer according to claim 15, wherein said polishing pad has said through hole at a site corresponding to a light transmitting part of the fixing layer.

17. A method for polishing a semiconductor wafer using a laminated body for polishing of a semiconductor wafer as defined in claim 15, which comprises a process of detecting a polishing endpoint by the use of an optical endpoint detecting apparatus.

18. A polishing pad for a semiconductor wafer, which comprises a substrate for a polishing pad provided with a through hole penetrating from surface to back, and a light transmitting part fitted in said through hole, wherein the substrate and the light transmitting part comprise a water-insoluble matrix material and a water-soluble particle dispersed in the water-insoluble matrix material, wherein the water-insoluble matrix material and the water-soluble particle in the substrate and the light transmitting part are the same, wherein the content of the water-soluble particle in the light transmitting part and the substrate is not the same, the content of the water-soluble particle in the light transmitting part is not less than 0.5% by volume and less than 5% by volume, and the content of the water-soluble particle in the substrate is from 20% by volume to 90% by volume, wherein % by volume is based on 100% by volume of the total amount of the water-insoluble matrix material and the water-soluble particle in the light transmitting part and the substrate, respectively.

19. The polishing pad for a semiconductor wafer according to claim 18, wherein a thickness of said light transmitting part is from 0.1 mm to 3 mm.

20. The polishing pad for a semiconductor wafer according to claim 18, wherein at least a part of the water-insoluble matrix material is a crosslinked polymer.

21. The polishing pad for a semiconductor wafer according to claim 20, wherein said crosslinked polymer is crosslinked 1,2-polybutadiene.

22. The polishing pad for a semiconductor wafer according to claim 18, wherein said light transmitting part is thinned.

23. The polishing pad for a semiconductor wafer according to claim 18, wherein a light transmittance of said light transmitting part at a wavelength between 400 and 800 nm is 0.1% or more, or an integrated transmittance of said light transmitting part in a wavelength range between 400 and 800 nm is 0.1% or more, when a thickness of said light transmitting part is 2 mm.

24. A laminated body for polishing of a semiconductor wafer, which comprises a polishing pad for a semiconductor wafer as defined in claim 18, and a supporting layer laminated on a backside of said polishing pad for a semiconductor wafer, wherein said laminate body has light transmitting properties in a laminated direction.

25. A method for polishing a semiconductor wafer using a polishing pad for a semiconductor wafer as defined in claim 18, which comprises a process of detecting a polishing endpoint by the use of an optical endpoint detecting apparatus.

26. A method for polishing a semiconductor wafer using a laminated body for polishing of a semiconductor wafer, which comprises a polishing pad for a semiconductor wafer as defined in claim 18, and a supporting layer laminated on a backside of said polishing pad for a semiconductor wafer, wherein said laminated body has light transmitting properties in a laminated direction, and which comprises a process of detecting a polishing endpoint by the use of an optical endpoint detecting apparatus.

27. The polishing pad for a semiconductor wafer according to claim 18, wherein said polishing pad comprises a fixing layer formed on a backside of at least the substrate for a polishing pad among the substrate for a polishing pad and the light transmitting part for fixing to a polishing apparatus, and wherein said polishing pad has said through hole at a site corresponding to a light transmitting part of the fixing layer.

* * * * *